US012539438B2

(12) United States Patent
Hartley

(10) Patent No.: US 12,539,438 B2
(45) Date of Patent: Feb. 3, 2026

(54) MAGNETIC FRACTIONAL WEIGHT PLATES FOR AN ADJUSTABLE WEIGHT-LIFTING DEVICE

(71) Applicant: Matt Hartley, Madison, MS (US)

(72) Inventor: Matt Hartley, Madison, MS (US)

( * ) Notice: Subject to any disclaimer, the term of this patent is extended or adjusted under 35 U.S.C. 154(b) by 0 days.

(21) Appl. No.: 19/050,810

(22) Filed: Feb. 11, 2025

(65) Prior Publication Data

US 2025/0256147 A1 Aug. 14, 2025

Related U.S. Application Data

(60) Provisional application No. 63/552,580, filed on Feb. 12, 2024.

(51) Int. Cl.
*A63B 21/072* (2006.01)
*A63B 21/075* (2006.01)

(52) U.S. Cl.
CPC ..... *A63B 21/0726* (2013.01); *A63B 21/0724* (2013.01); *A63B 21/0728* (2013.01); *A63B 21/075* (2013.01); *A63B 2209/08* (2013.01)

(58) Field of Classification Search
CPC ..... A63B 21/0726; A63B 21/0728; A63B 21/075; A63B 21/0724; A63B 2209/08
See application file for complete search history.

(56) References Cited

U.S. PATENT DOCUMENTS 5,040,787 A * 8/1991 Brotman ..... A63B 21/072 482/106
5,735,777 A * 4/1998 Benoit ..... A63B 21/0728 482/106
6,193,635 B1 * 2/2001 Webber ..... A63B 21/063 482/99
6,837,833 B2 * 1/2005 Elledge ..... A63B 21/0728 482/110
7,785,239 B2 * 8/2010 Daniel ..... A63B 21/0728 482/93
10,252,098 B2 * 4/2019 Wilke ..... A63B 21/00065
11,324,988 B1 * 5/2022 Reed ..... A63B 21/0728
2007/0298940 A1 * 12/2007 Anderson ..... A63B 21/0728 482/107

(Continued)

FOREIGN PATENT DOCUMENTS

KR 20140090895 A * 7/2014 ..... A63B 21/0052

*Primary Examiner* — Joshua T Kennedy
(74) *Attorney, Agent, or Firm* — HULSEY P.C.

(57) ABSTRACT

Magnetic fractional weight plates for use with an adjustable weight-lifting device, such as dumbbell and barbell is disclosed. Each magnetic fractional weight plate includes a body. The body may have a pie-like structure, an arc-like configuration, or a three-quadrant circular configuration. The body magnetically attaches to a weight plate of the adjustable weight-lifting device. In some implementations, the magnetic fractional weight plate includes protrusions extending from the body. The protrusions insert into grooves in the weight plate. In one example, each magnetic fractional weight plate weighs approximately 1.25 pounds, thereby enabling a user to add 2.5 pounds of incremental weights to the adjustable weight-lifting device. The magnetic fractional weight plates attach directly to the interfacing weight plates and avoid their removal each time the user adds or removes the weight plates to customize their workout intensity.

9 Claims, 13 Drawing Sheets

(56) References Cited

U.S. PATENT DOCUMENTS

| | | | | |
|---|---|---|---|---|
| 2008/0153678 | A1* | 6/2008 | McClusky | A63B 21/0728 482/106 |
| 2010/0075816 | A1* | 3/2010 | Anderson | A63B 21/0728 482/107 |
| 2017/0080275 | A1* | 3/2017 | Wilke | A61B 5/11 |
| 2019/0388723 | A1* | 12/2019 | Nalley | A63B 21/0604 |
| 2021/0339072 | A1* | 11/2021 | Benoit | A63B 21/0728 |
| 2023/0226398 | A1* | 7/2023 | Courtney | A63B 21/0724 482/136 |
| 2023/0347200 | A1* | 11/2023 | Casagrande | A63B 21/075 |

* cited by examiner

MAGNETIC FRACTIONAL WEIGHT PLATES FOR AN ADJUSTABLE WEIGHT-LIFTING DEVICE

CROSS-REFERENCE TO RELATED APPLICATIONS

The present application claims benefit of U.S. Provisional Application No. 63/552,580, filed Feb. 12, 2024; which is incorporated herein in its entirety and referenced thereto.

BACKGROUND OF THE INVENTION

Field of the Invention

The present invention relates to the field of exercise equipment, and in particular, relates to a magnetic fractional weight plate for use with an adjustable weight-lifting device, such as a dumbbell.

Description of the Prior Art

It is known that weight-lifting devices such as dumbbells or barbells are used by fitness enthusiasts for a wide range of exercises targeting different muscle groups such as upper body, lower body, and core workouts. Typically, the dumbbells come in various weights and enable the fitness enthusiasts to gradually increase resistance as they build strength. The dumbbells designs have evolved to encompass fixed-weight dumbbells and adjustable dumbbells. The fixed-weight dumbbells are typically manufactured in increments of five pounds (5 lbs), 10 pounds, etc. The adjustable dumbbells consist of a handle and weight plates that are adjusted to different weight increments. The adjustable dumbbells also come with limited weight increments, typically in 5 or 10 pounds increments. While these weight increments are enough for general fitness needs, they do not allow for finer/smaller weight adjustments, say 1 to or 2.5 pounds.

In order to overcome the above problem, fractional weight plates have been introduced. The fractional weight plates add smaller weight increments, such as 1 to 2.5 pounds increments, to the dumbbells. The fractional weight plates enable the fitness enthusiasts to gradually progress their workouts and target specific muscle groups more effectively. An example of adding fractional weight plates to the dumbbells is disclosed in a U.S. Pat. No. 11,324,988, entitled "Weight modification clamp and method" ("the '988 Patent"). The '988 Patent discloses a weight modification clamp includes first and second hingedly connected plates configured to be coupled to a bar of a weight-lifting device, such as a dumbbell, barbell or a kettlebell. First end portions of the first and second plates are pivotably connected and movable about a rotational axis so that opposing second end portions of the first and second plates are movable between a closed orientation and an open orientation and along a plane substantially perpendicular to the rotational axis. The first and second plates define a central opening configured to receive and retain the bar therein.

Another example is disclosed in a U.S. Pat. No. 10,252,098, entitled "Fine weight-adjustment device for free-weight fitness equipment" ("the '098 Patent"). The '098 Patent discloses a device for fine weight adjustment of a host apparatus. The host apparatus can be a free weight or similar having a bar with a bar diameter. The device can have an annular or disc-shaped body. The annular body can have an inner disc perimeter defining a central aperture having a diameter substantially similar to the bar diameter of the host apparatus. The annular body can also have a slot extending through the annular body from an outer perimeter to the central aperture defining a first disc end and a second disc end separated by a slot width. The annular body can be formed of a material having an elasticity sufficient to allow axial flexibility that returns the annular body to its original shape after being deformed to fit around the bar of the host apparatus.

Although the above discussed disclosures are useful, they still have problems and present incomplete solutions. For example, the fractional weight plates are primarily used for traditional dumbbells as they clamp onto a handle of the dumbbell. Clamping the fractional weight plates to the handle may come in contact with the user's hand holding the handle and hinder their exercise routine. Further, in case the user needs to use another dumbbell of different weight, then the user has to remove the fractional weight plates and add them to the different dumbbells. Other fine weight-adjustment devices typically mount at the distal ends of the dumbbells. As a result, the user has to remove all the weights before mounting the fine weight-adjustment devices back onto the dumbbells.

Therefore, there is a need in the art to provide an improved magnetic weight plate for use with an adjustable weight-lifting device such as a dumbbell that can be used without having to remove from the weight plates.

SUMMARY OF THE INVENTION

It is an object of the present invention to provide improved magnetic fractional weight plates for use with an adjustable weight-lifting device such as a dumbbell.

It is another object of the present invention to provide magnetic fractional weight plates that connect directly to the weight plates of the weight-lifting device.

It is another object of the present invention to provide magnetic fractional weight plates that connect directly to interfacing weight plates and avoid removal of the magnetic fractional weight plates while adding or removing additional weight plates to the adjustable weight-lifting device (dumbbell, for example).

In order to achieve one or more objects, the present invention provides magnetic fractional weight plates for use with an adjustable weight-lifting device, such as a dumbbell. Each magnetic fractional weight plate includes a body. The body may have a pie-like structure, an arc-like configuration, or three quadrant circular configuration. The body magnetically attaches to a weight plate of the adjustable weight-lifting device. In some implementations, the body includes magnetic members flushed with the surface of the body. The magnetic members vary in shape and size and facilitate the connection of the body to the weight plate of the adjustable weight-lifting device.

In one aspect, the magnetic fractional weight plate includes protrusions positioned over the body. The protrusions are either made up of metal or magnetic members. The protrusions insert into grooves in the weight plates. Here, the body or the protrusions are configured to magnetically attach to opposing weight plates of the adjustable weight-lifting device.

Each magnetic fractional weight plate weighs approximately 1.25 pounds, thereby enabling a user to add incremental weights of 2.5 pounds to the adjustable weight-lifting device.

In one advantageous feature of the present invention, the magnetic fractional weight plates attach directly to the interfacing weight plates and avoid their removal each time the user adds or removes the weight plates to customize their workout intensity.

In another advantageous feature of the present invention, the magnetic fractional weight plates attach magnetically to the weight plates of the adjustable weight-lifting device. This ensures a secure fit that prevents them from falling off during workouts, and eliminates the risk of accidents and distractions while exercising.

In another advantageous feature of the present invention, each magnetic fractional weight plate weighs approximately 1.25 pounds, allowing users to add 2.5 pounds incrementally to their adjustable weight-lifting device.

These and other objects of the present subject matter will be apparent from review of the following specification and the accompanying drawings.

DETAILED DESCRIPTION OF THE PREFERRED EMBODIMENT

Figure 1:
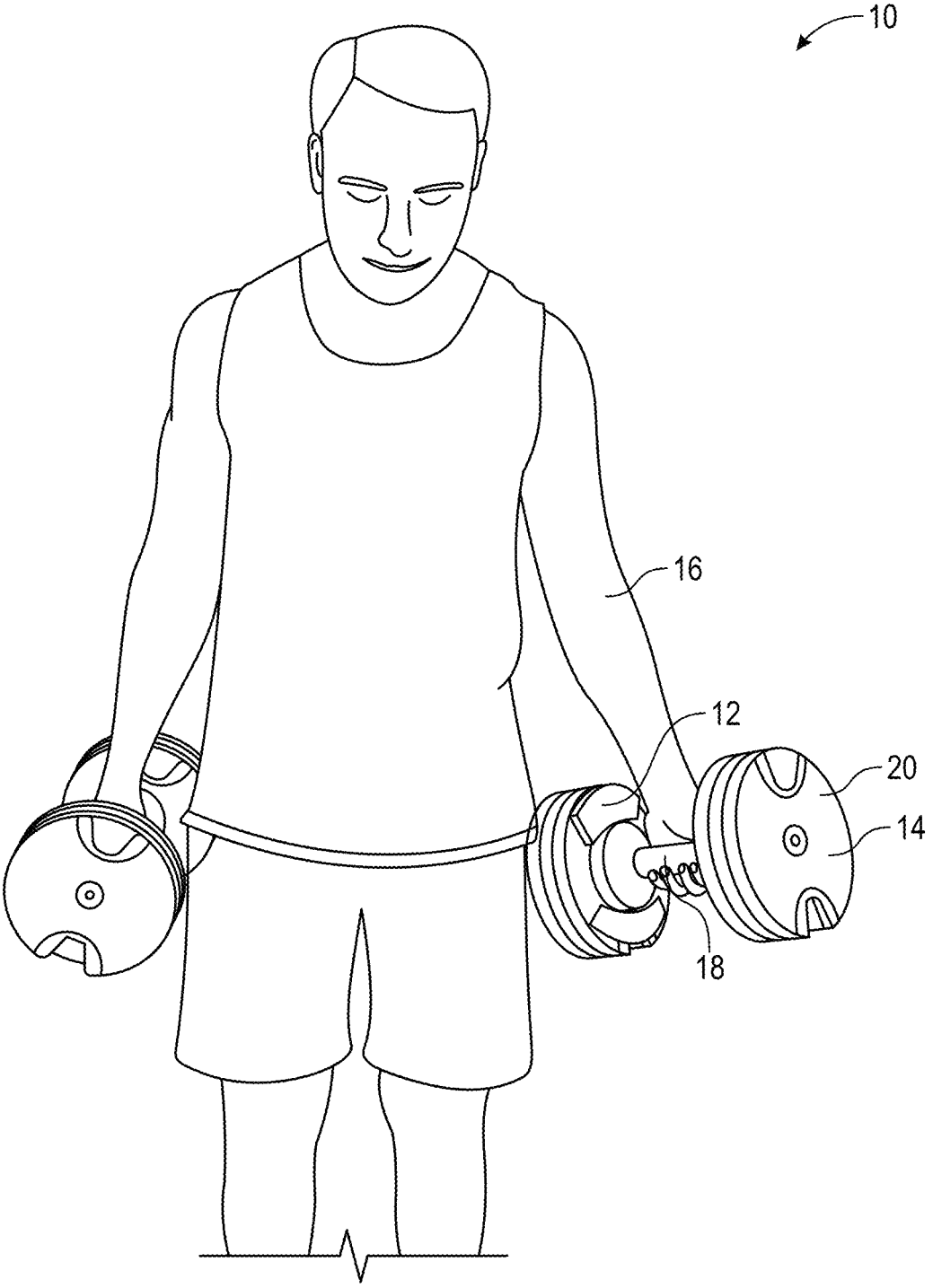
FIG. 1 illustrates an environment in which magnetic fractional weight plates are implemented, in accordance with one embodiment of the present invention.
Figure 2A:
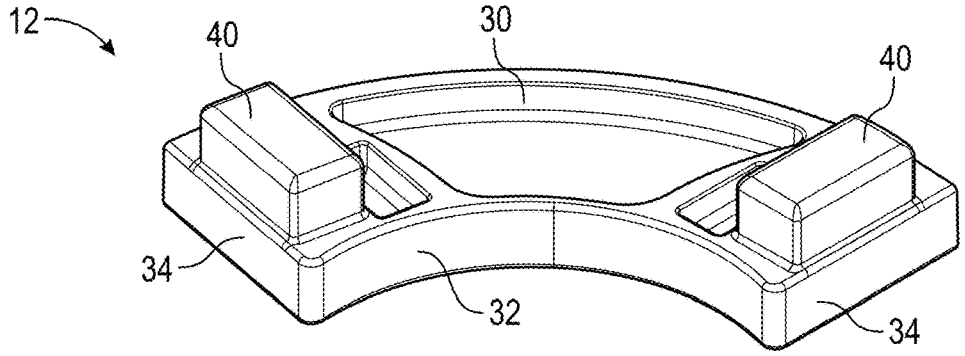
FIG. 2A, FIG. 2B, FIG. 2C, FIG. 2D, and FIG. 2E, illustrate a front perspective view, a bottom view, a side view, a side perspective view and a top perspective view, respectively of the magnetic fractional weight plate, in accordance with one embodiment of the present invention.
Figure 2B:
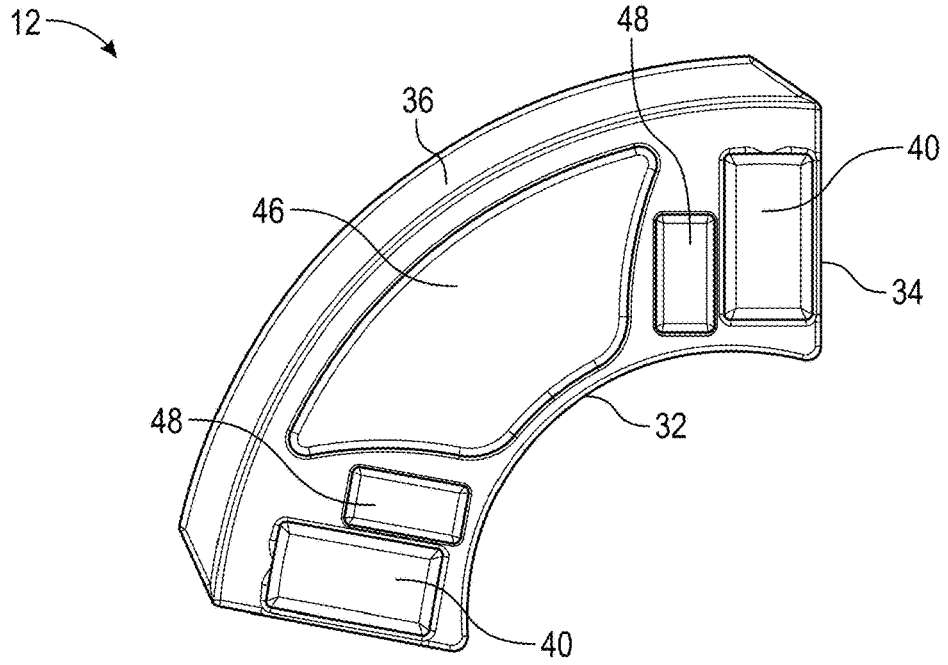
Figure 2C:
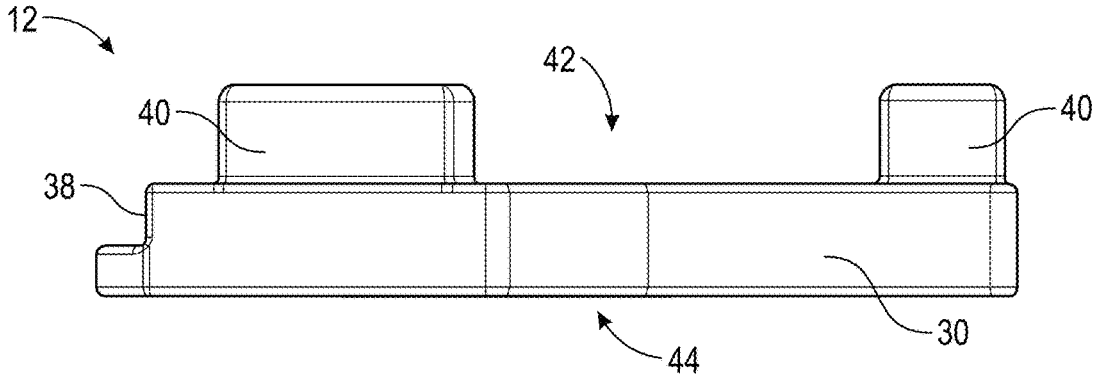
Figure 2D:
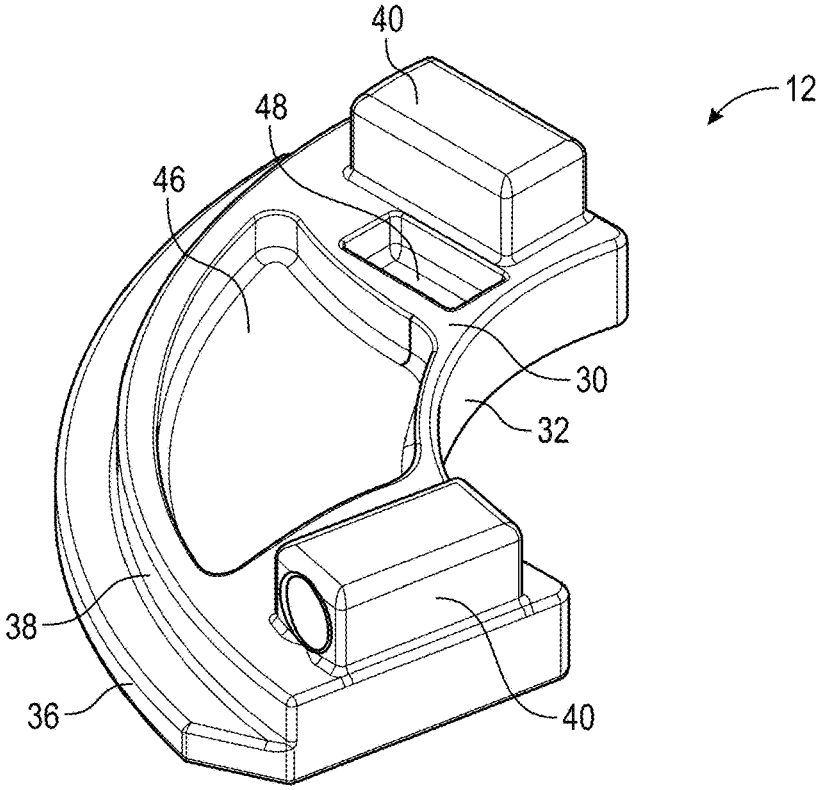
Figure 2E:
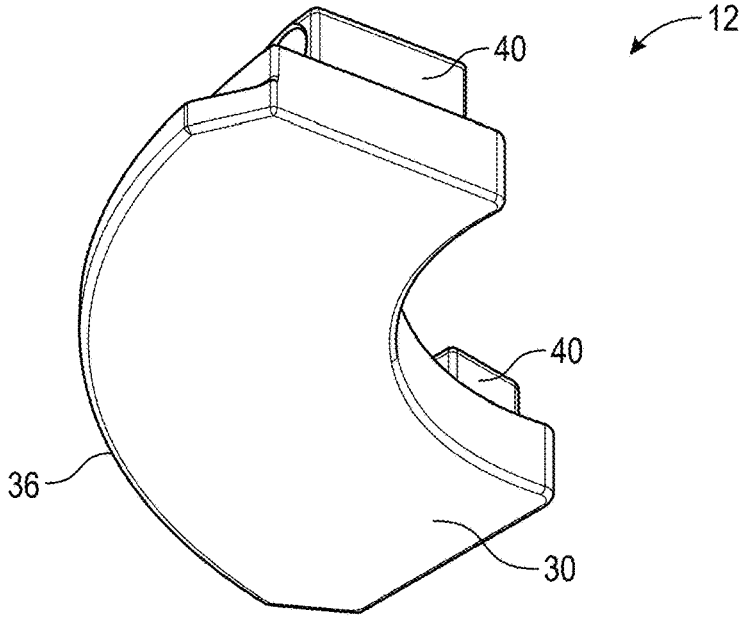

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed magnetic fractional weight plates. However, it will be apparent to those skilled in the art that the presently disclosed invention may be practiced without these specific details. In some instances, well-known structures and devices are shown in functional or conceptual diagram form in order to avoid obscuring the concepts of the presently disclosed magnetic fractional weight plates.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

It will be understood that, although the terms first, second, third, etc. may be used herein to describe various elements, components, regions, and/or sections, these elements, components, regions, and/or sections should not be limited by these terms. These terms are only used to distinguish one element, component, region, and/or section from another element, component, region, and/or section.

It will be understood that the elements, components, regions, and sections depicted in the figures are not necessarily drawn to scale.

Although the present invention provides a description of magnetic fractional weight plates, it is to be further understood that numerous changes may arise in the details of the embodiments of the magnetic fractional weight plates. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

Various features and embodiments of magnetic fractional weight plates are explained in conjunction with the description of FIGS. 1-10.

FIG. 1 shows an environment 10 in which magnetic fractional weight plates 12 are implemented, in accordance with one embodiment of the present invention. Magnetic fractional weight plates 12 connect to an adjustable weight-lifting device 14. An example of weight-lifting device 14 includes, but not limited to, dumbbell, barbell, etc. A user 16 holds a handle 18 and lifts adjustable weight-lifting device 14 containing a plurality of weight plates 20 (and magnetic fractional weight plates 12) connected to handle 18.

Referring now to FIG. 2A, FIG. 2B, FIG. 2C, FIG. 2D, and FIG. 2E, a front perspective view, a bottom view, a side view, a side perspective view and a top perspective view, respectively of a magnetic fractional weight plate 12 is shown, in accordance with one embodiment of the present invention. Magnetic fractional weight plates 12 is made of a metal or any suitable material. In one example, magnetic fractional weight plate 12 is made of a magnetic material. In one implementation, each magnetic fractional weight plate 12 is configured to weigh about 1.25 pounds (1.25 lbs.). A person skilled in the art understands that magnetic fractional weight plate 12 can be configured with incremental smaller weights of about 1.5, 2, 2.5 pounds without departing from the scope of the present invention. Magnetic fractional weight plate 12 includes a body 30. Body comes in a quarter-circle configuration or pie slice or arc-like configuration. Body 30 presents an inner curvature 32. Body 32 includes tapered sections 34 extending from inner curvature 32. Further, body 30 includes an outer curvature 36. Outer curvature 36 connects tapered sections 34 and forms a pie-like structure together with inner curvature 32 and tapered sections 34. In one implementation, outer curvature 36 includes a step-like structure 38, as can be seen from at least FIG. 2C, and FIG. 2D.

Magnetic fractional weight plate 12 presents a first end 42 and a second end 44. First end 42 indicates a bottom end and second end 44 indicates a top end. In the present embodiment, body 30 encompasses protrusions 40. Protrusions 40 extend from body 30 towards first end 42. In one example, protrusions 40 come in rectangular configuration. It should be understood that protrusions 40 can come in any other shape including, but not limited to, semi-circular, circular, square, triangle, etc. In some implementations, body 30 encompasses a first cut-section 46, and second cut-sections 48. In one example, each of first cut-section 46 and second cut-sections 48 may come in any shape. First cut-section 46 and second cut-sections 48 may be formed by cutting a groove/portion of body 30 at a suitable depth enabling user 16 to place his/her hands while connecting magnetic fractional weight plates 12 to weight plate 20. Optionally, step-like structure 38 protrudes out from adjustable dumbbell 14 and enables to user 16 to install/uninstall magnetic fractional weight plate 12 to weight plate 20.

In one implementation, the entire magnetic fractional weight plate 12 (i.e., both body 30 and protrusions 40) is made of a magnetic member. In some implementations, body 30 is made of a metal and protrusions 40 are made of magnetic members. Optionally, body 30 is made of metal and protrusions 40 are made of magnetic members. A person skilled in the art understands body 30 enabling magnetic connection with weight plates 20 in a variety of ways falls within the scope of the present invention.

Figure 3:
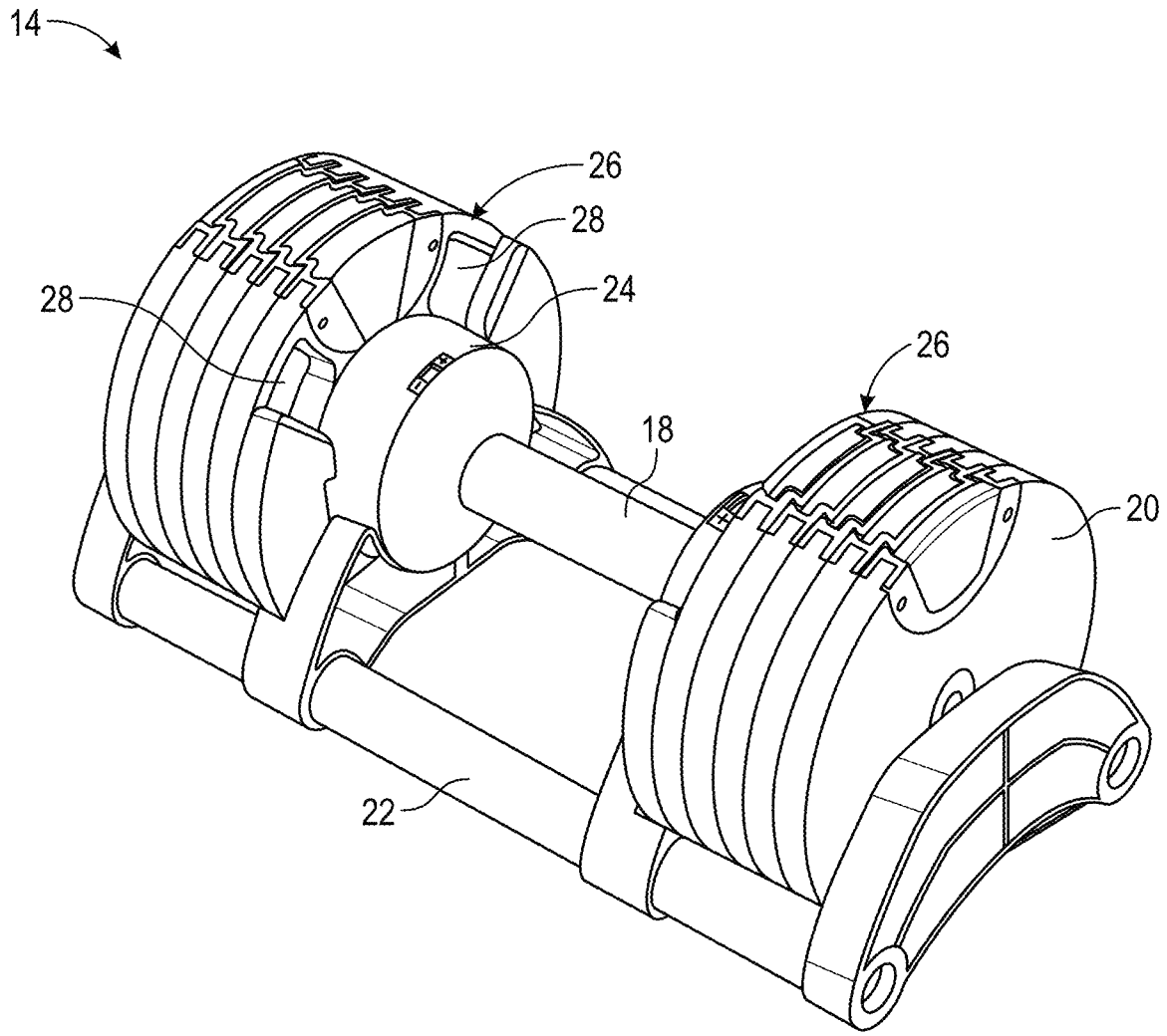
FIG. 3 illustrates an adjustable weight-lifting device, in accordance with prior art.

Now referring to FIG. 3, a perspective view of adjustable weight-lifting device 14 is shown, as known in the art. Adjustable weight-lifting device 14 rests in a rack 22. As known, adjustable weight-lifting device 14 encompasses a housing 24 allowing user 16 to adjust handle 16 to connect to opposite weight plates 20 for lifting them together. As known, handle 16 enables connecting opposite weight plates 20 with a weight interval: 5-pound, 10-pound, 15-pound, 20-pound, 25-pound, etc. Housing 24 typically connects to a first weight plate 20 interfacing handle 16. First weight plate 20 encompasses a gap 26 and provides access to grooves 28 in (first) weight plate 20.

Figure 4:
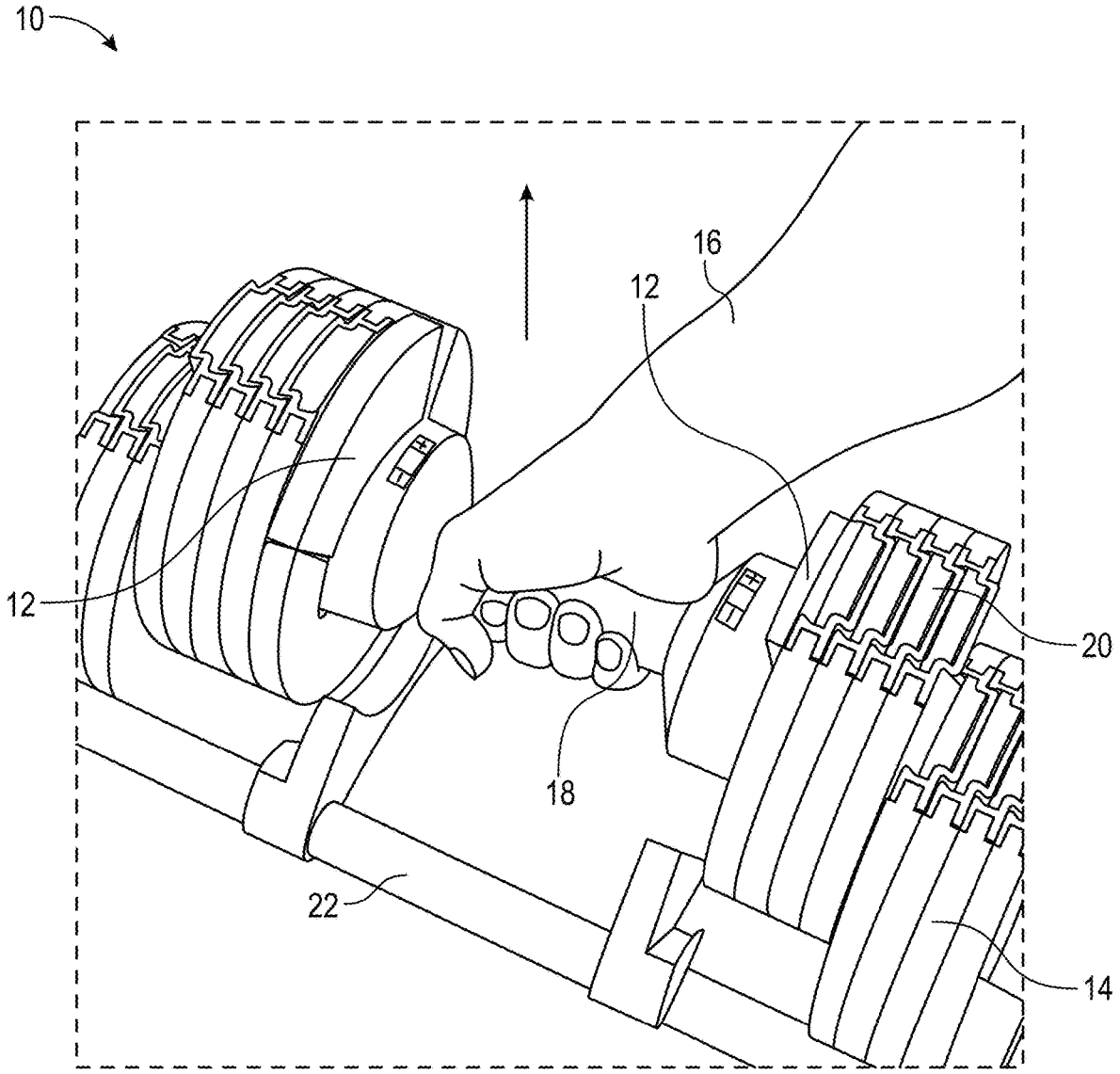
FIG. 4 illustrates the user lifting the adjustable weight-lifting device connecting the magnetic fractional weight plates, in accordance with one embodiment of the present invention.

In order to connect magnetic fractional weight plate 12 to weight plate 20, first end 42 of magnetic fractional weight plate 12 is made to face weight plate 20. Subsequently, protrusions 40 are made to insert into grooves 28 enabling the magnetic connection between magnetic fractional weight plate 12 and weight plate 20. Here, user 16 adds a pair of magnetic fractional weight plates 12 i.e., each magnetic fractional weight plate 12 to opposite weight plates 20. As each magnetic fractional weight plate 12 weighs 1.25 pounds, two magnetic fractional weight plates 12 add a total of 2.5 pounds to adjustable weight-lifting device 14. After connecting, user 16 adjusts handle 16 to connect to required weight plates 20 depending on the weight requirement and lifts adjustable weight-lifting device 14 connecting magnetic fractional weight plates 12, as shown in FIG. 4.

Figure 5:
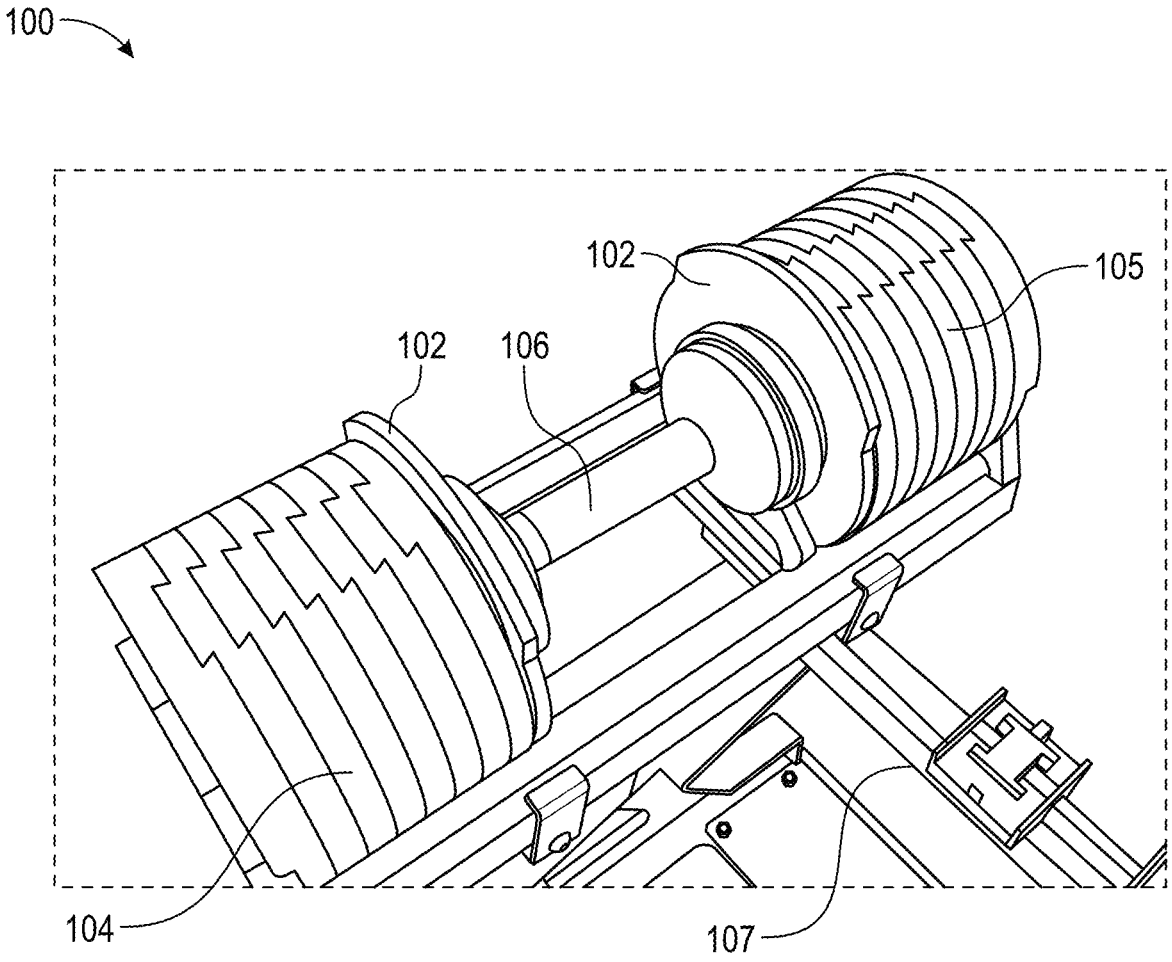
FIG. 5 illustrates an environment in which magnetic fractional weight plates are implemented, in accordance with another embodiment of the present invention.
Figure 6A:
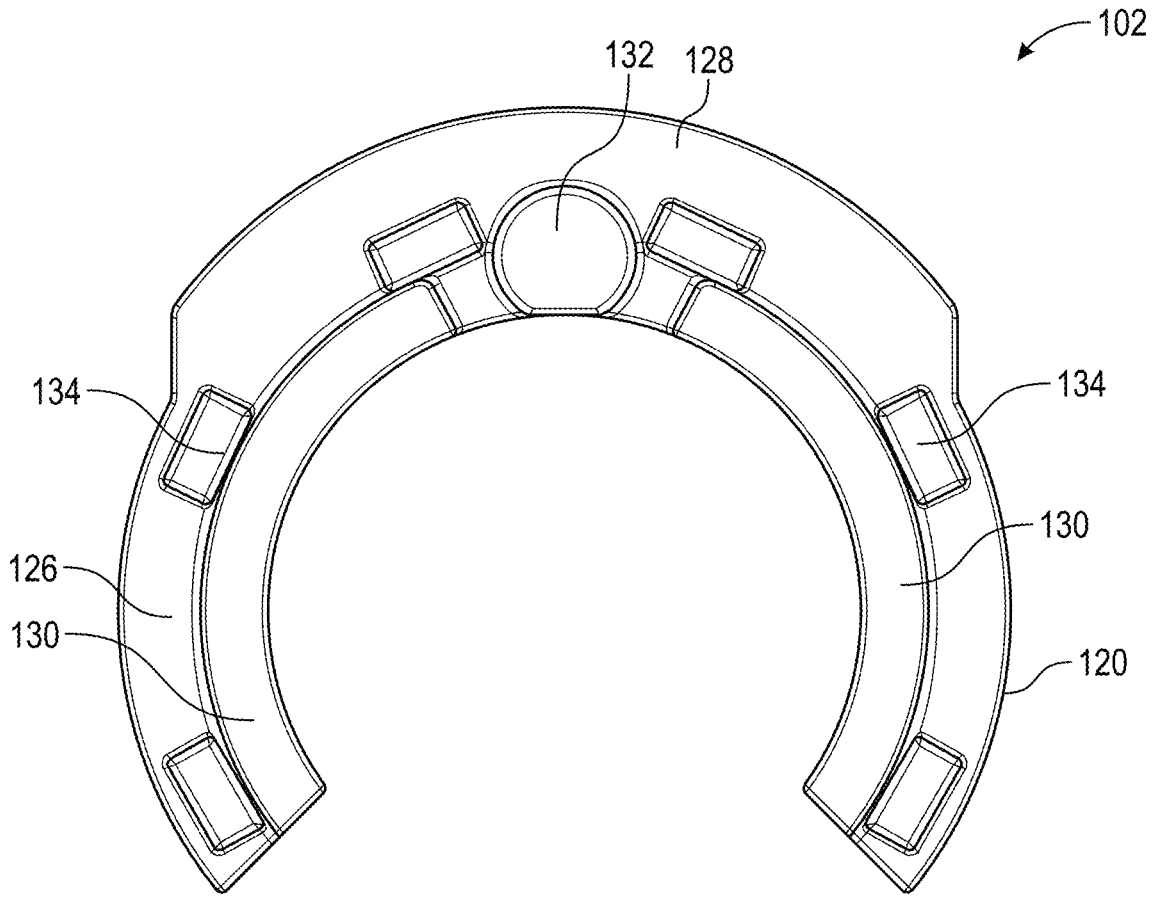
FIG. 6A, FIG. 6B, FIG. 6C and FIG. 6D illustrate a bottom view, a side view, a bottom perspective view and a side perspective view, respectively of the magnetic fractional weight plate, in accordance with another embodiment of the present invention.
Figure 6B:
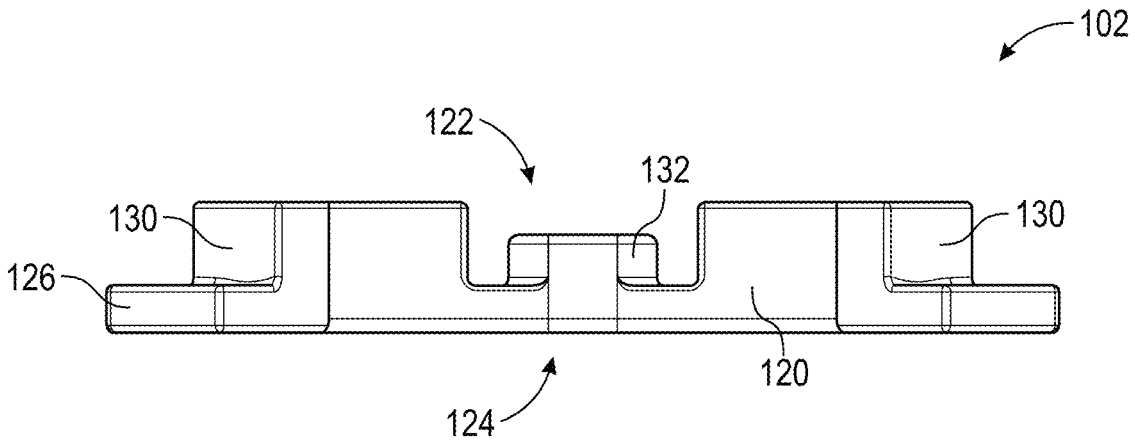
Figure 6C:
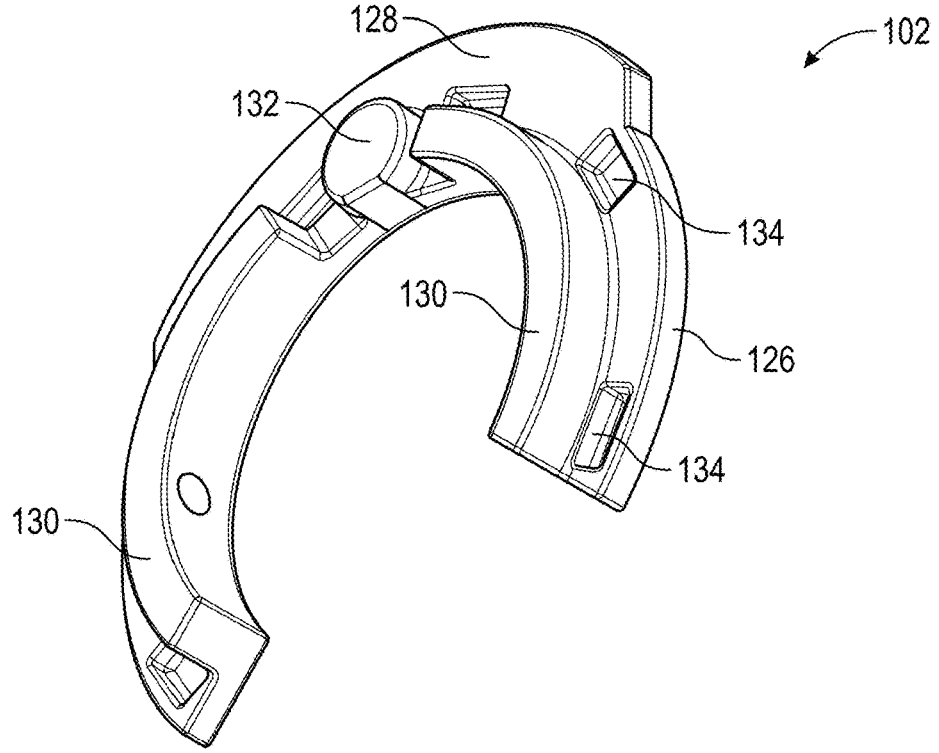
Figure 6D:
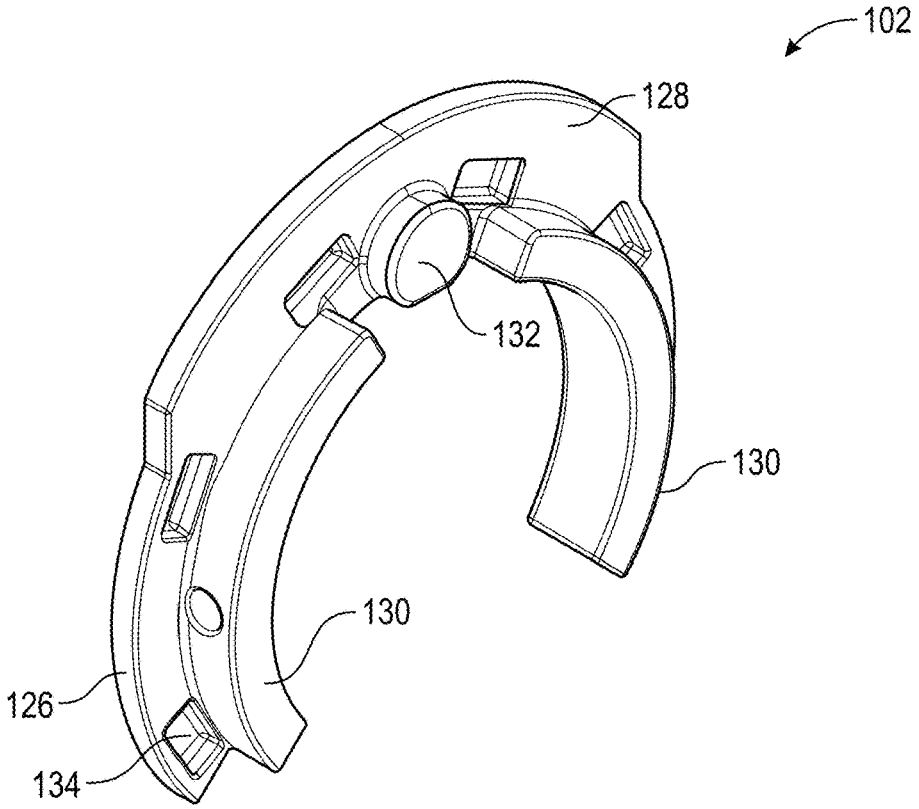
Figure 7:
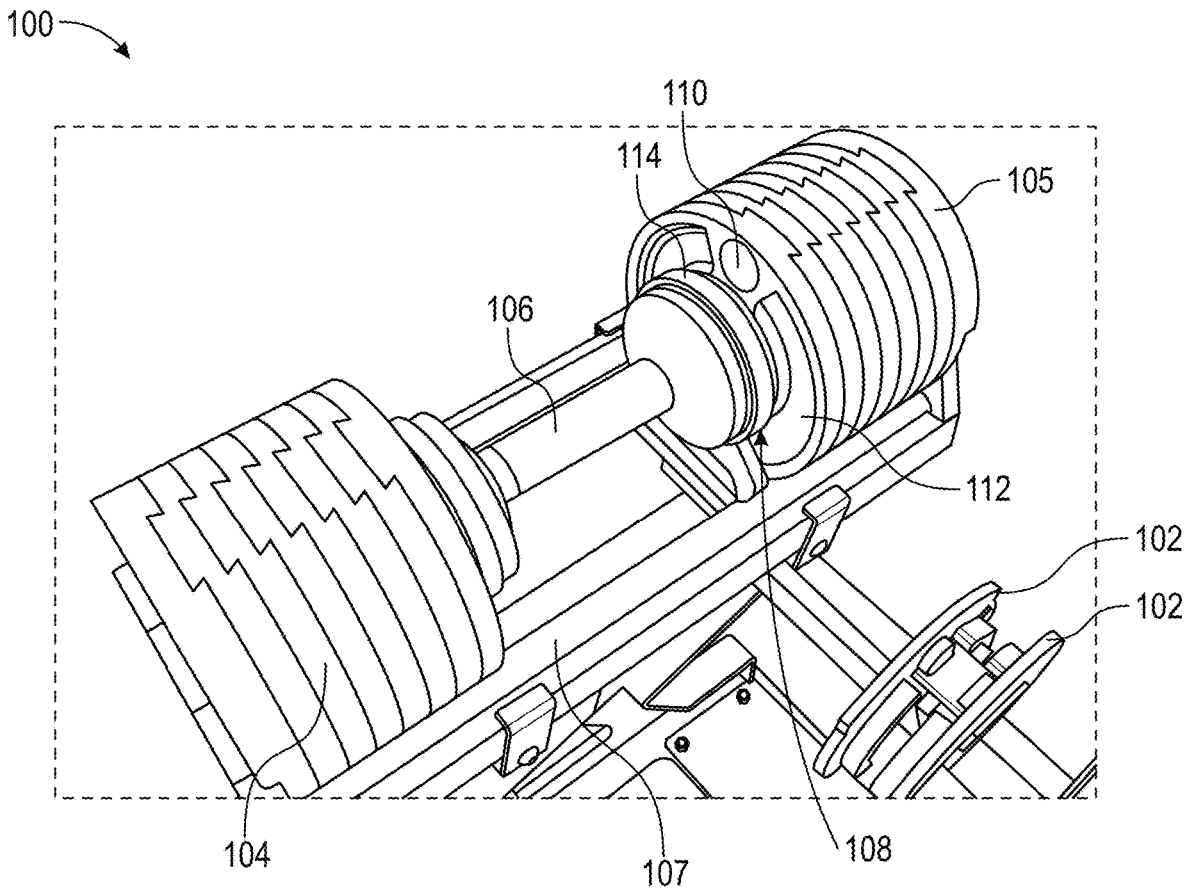
FIG. 7 illustrates a rack holding an adjustable weight-lifting device and the magnetic fractional weight plates, in accordance with another embodiment of the present invention.

Referring now to FIG. 5, an environment 100 in which magnetic fractional weight plates 102 are implemented is shown, in accordance with another embodiment of the present invention. Magnetic fractional weight plates 102 connect to an adjustable weight-lifting device 104 having a handle 106 connecting to weight plates 105. An example of weight-lifting device 104 includes, but not limited to, dumbbell, barbell, etc. Adjustable weight-lifting device 104 sits on a rack 107, as shown in FIG. 7. When not in use, magnetic fractional weight plates 102 are placed on a side of adjustable weight-lifting device 104 over rack 107. As specified above, adjustable weight-lifting device 104 presents interfacing grooves 108, such as first groove 110, and second grooves 112. First groove 110 comes in a circular configuration. Second grooves 112 come in an arc-like configuration. Handle 106 presents a housing 114 that enables operation of handle 106 to connect to weight plates 105.

FIG. 6A, FIG. 6B, FIG. 6C and FIG. 6D show a bottom view, a side view, a bottom perspective view and a side perspective view, respectively of magnetic fractional weight plate 102. Magnetic fractional weight plate 102 is made of a metal or any suitable material. In one example, magnetic fractional weight plates 102 is made of magnetic material. In one implementation, each magnetic fractional weight plate 102 is configured to weigh about 1.25 pounds (1.25 lbs.). A person skilled in the art understands that magnetic fractional weight plate 102 can be configured with an incremental smaller weights of about 1.5, 2, 2.5 pounds without departing from the scope of the present invention.

Magnetic fractional weight plate 102 includes a body 120. Body 120 presents a first end 122 and a second end 124. First end 122 indicates a bottom end and second end 124 indicates a top end. Body 120 encompasses a first section 126, and a second section 128 extending from first section 126. In one example, first section 126 comes in a three quadrant circular configuration. Optionally, first section 126 comes in a semi-circular configuration. Second section 128 extends from first section 126 and comes in the shape of an arc. In the present embodiment, body 120 encompasses first protrusions 130. First protrusions 130 extend from body 120 towards first end 122. In one example, each first protrusion 130 comes in an arc configuration and faces opposite first protrusion 130. In some implementations, body 120 presents a second protrusion 132. Second protrusion 132 comes in a circular configuration and positions in between first protrusions 130. Further, body 120 presents a plurality of cut-sections 134. Cut-sections 134 may come in any shape and position adjacent to first protrusions 130 and second protrusion 132. In some implementations, cut-sections 134 help to hold magnetic fractional weight plate 102.

In one implementation, the entire magnetic fractional weight plate 102 (i.e., both body 120 and protrusions 130, 132) is made of a magnetic member. In some implementations, body 120 is made of a metal, and first protrusions 130 and second protrusion 132 are made of magnetic members. Optionally, body 120 is made of metal and first protrusions 130 and second protrusion 132 are made of magnetic members. A person skilled in the art understands body 120 enabling magnetic connection with weight plate 20 in a variety of ways falls within the scope of the present invention.

As specified above, FIG. 7 shows magnetic fractional weight plates 102 placed over rack 107 when not in use. In order to connect magnetic fractional weight plates 102 to adjustable weight-lifting device 104, a user (not shown) removes magnetic fractional weight plates 102 from rack 107 and connects magnetic fractional weight plates 102 to interfacing grooves 108. Specifically, the user connects magnetic fractional weight plates 102 such that first protrusions 130 sit in second grooves 112, and second protrusion 130 sits in first groove 110. The user adds a pair of magnetic fractional weight plates 102 i.e., each magnetic fractional weight plate 102 to opposite weight plates 105. As each magnetic fractional weight plate 102 weighs 1.25 pounds, two magnetic fractional weight plates 102 add a total of 2.5 pounds to adjustable weight-lifting device 104. After connecting, the user adjusts handle 106 to connect to required weight plates 105 depending on the need and lifts adjustable weight-lifting device 104 connecting magnetic fractional weight plates 102.

Figure 8:
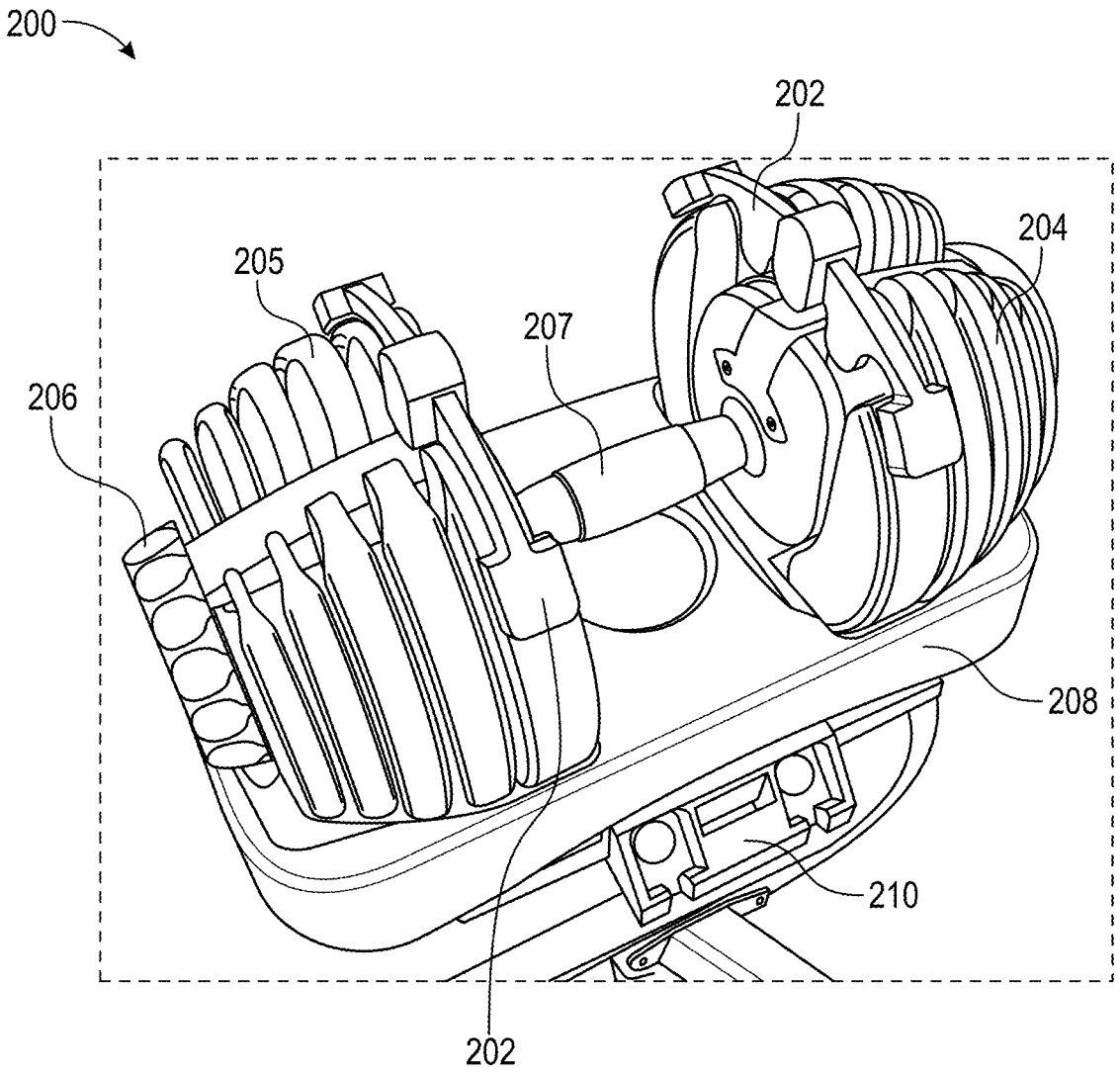
FIG. 8 illustrates an environment in which magnetic fractional weight plates are implemented, in accordance with another embodiment of the present invention.
Figure 9A:
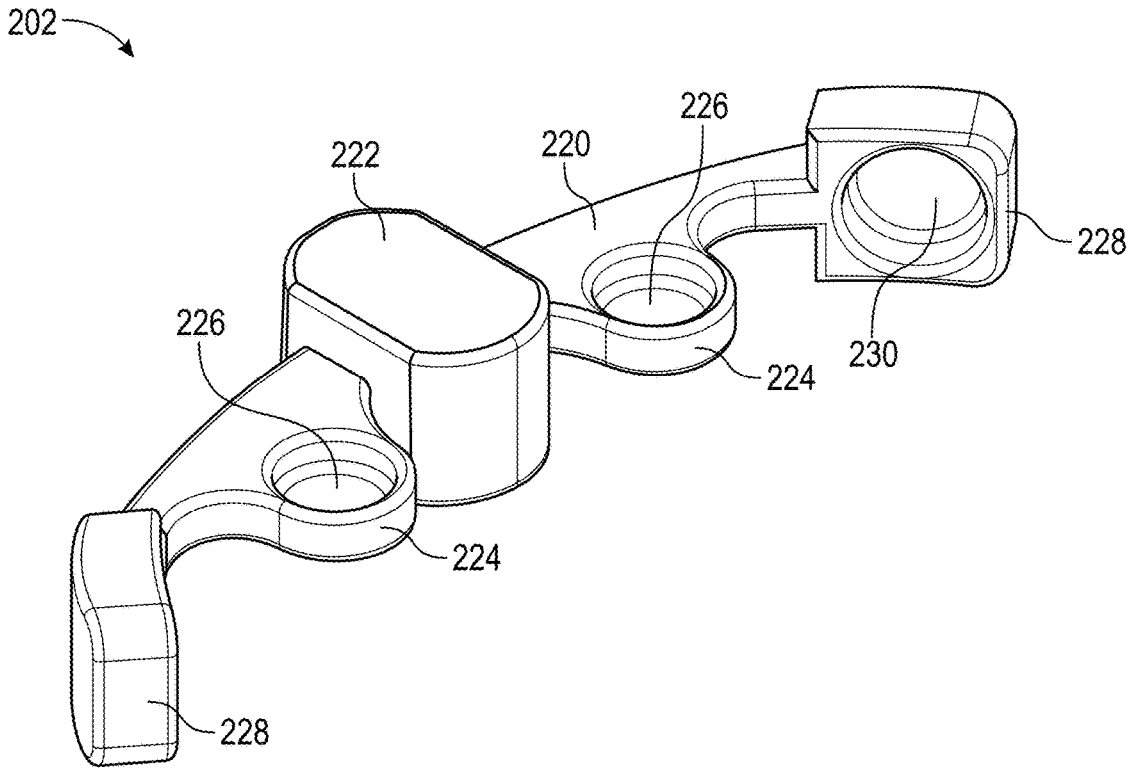
FIG. 9A, FIG. 9B, FIG. 9C and FIG. 9D illustrate a bottom perspective view, a front view, a top perspective view and a top view, respectively of the magnetic fractional weight plate, in accordance with another embodiment of the present invention.
Figure 9B:
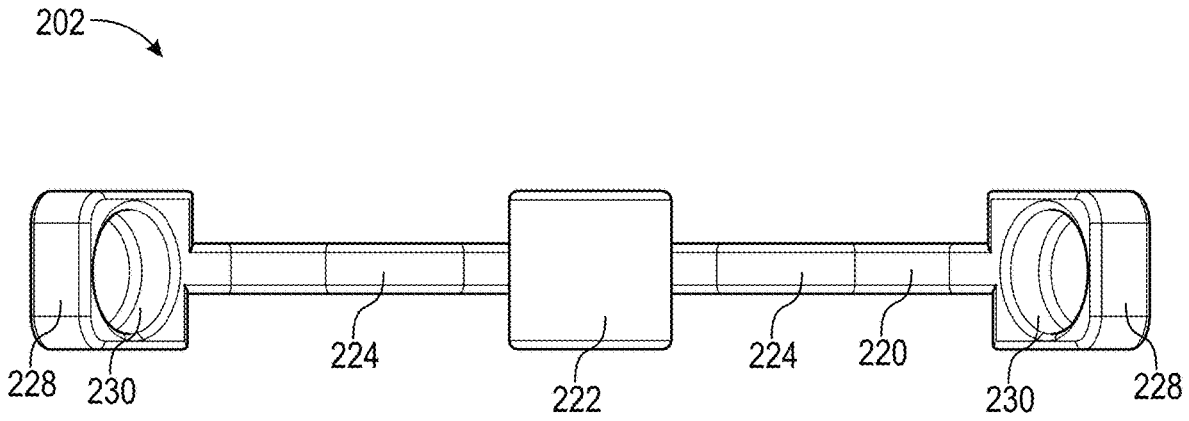
Figure 9C:
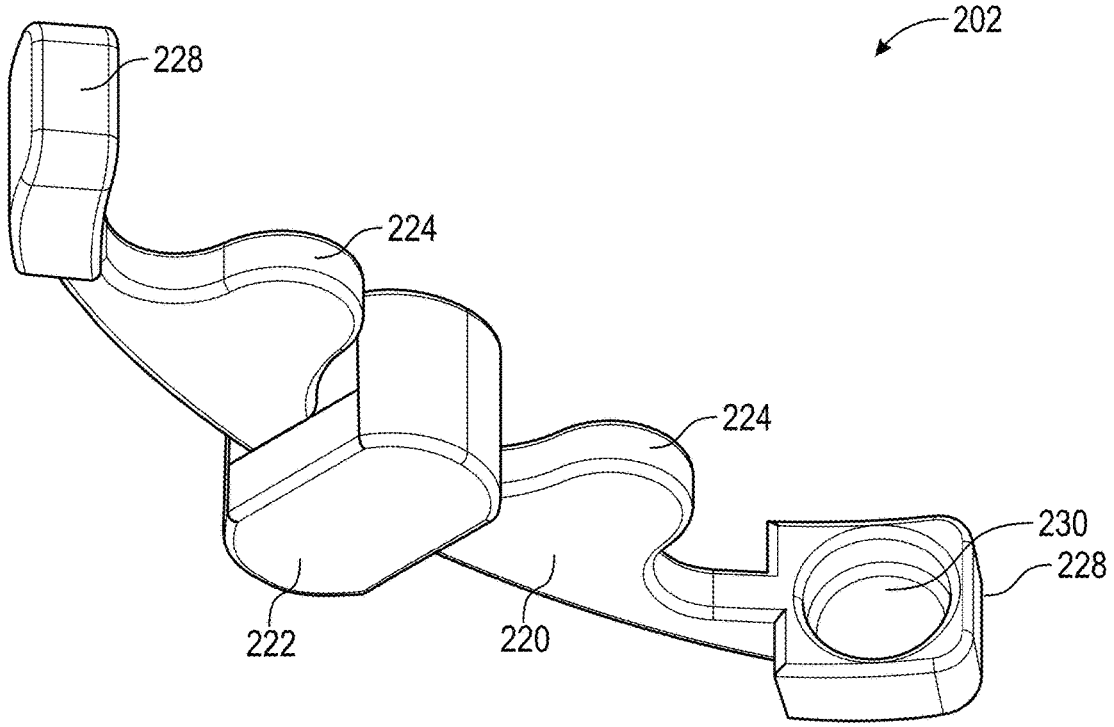
Figure 9D:
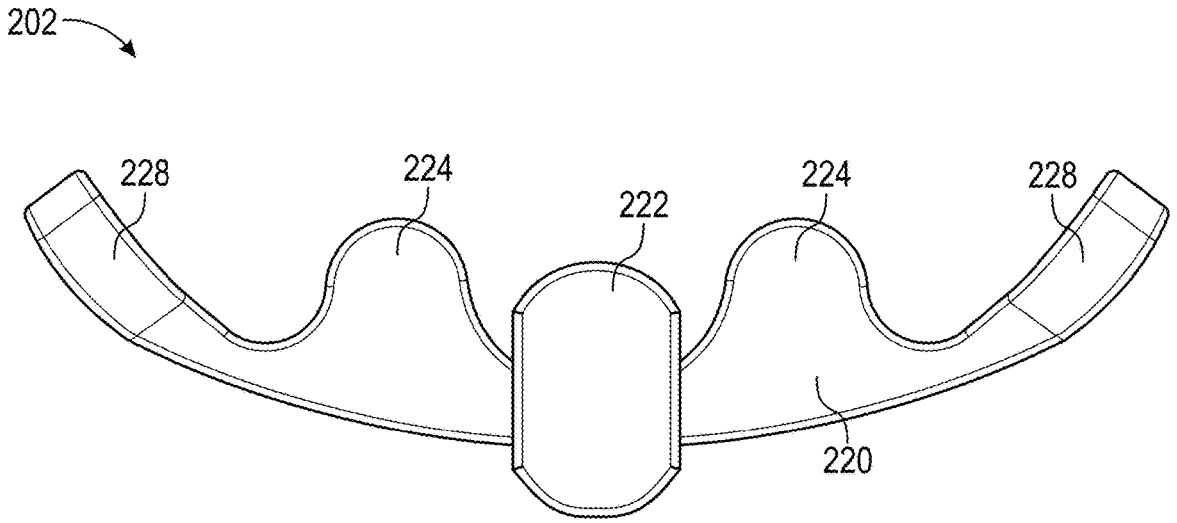
Figure 10:
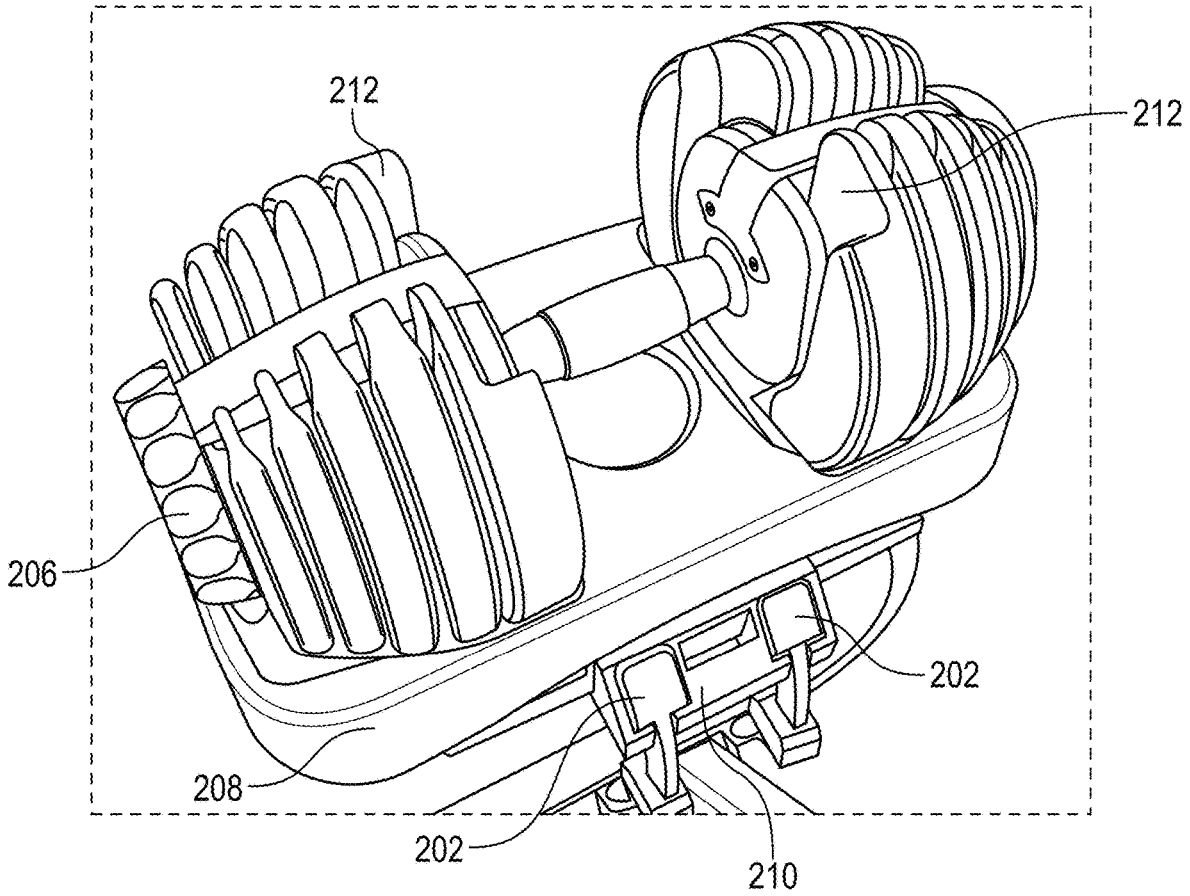
FIG. 10 illustrates a rack holding an adjustable weight-lifting device and the magnetic fractional weight plates, in accordance with another embodiment of the present invention.

FIG. 8 shows an environment 200 in which magnetic fractional weight plates 202 are implemented, in accordance with another embodiment of the present invention. Magnetic fractional weight plates 202 connect to an adjustable weight-lifting device 204 having a handle 207 connecting to weight plates 205. Adjustable weight-lifting device 204 sits on a rack 208. In this embodiment, weight adjuster 206 positions at the distal end of weight plates 205. Further, rack 208 includes a fractional weight plate receiving section 210 for receiving magnetic fractional weight plates 202 when not in use, as shown in FIG. 10. In the present embodiment, adjustable weight-lifting device 204 presents interfacing grooves 212 at weight plates 205.

FIG. 9A, FIG. 9B, FIG. 9C and FIG. 9D show a bottom perspective view, a front view, a top perspective view and a top view, respectively of magnetic fractional weight plate 202. Magnetic fractional weight plate 202 is made of a metal or any suitable material. In one example, magnetic fractional weight plates 202 is made of a magnetic material. In one implementation, each magnetic fractional weight plate 202 is configured to weigh about 1.25 pounds. A person skilled in the art understands that magnetic fractional weight plate 202 can be configured with an incremental smaller weights of about 1.5, 2, 2.5 pounds without departing from the scope of the present invention.

Magnetic fractional weight plates 202 includes a body 220. Body 220 comes in an arc-like configuration. Body 220 encompasses a first section 222. First section 222 comes in an oval cylindrical configuration and positions at the center of body 220. Body 220 presents first protrusions 224, each positioned adjacent to first section 222 (at both sides). First protrusions 224 extend from body 222. First protrusions 224 present first cut-sections 226 formed by chipping off a portion of material from first protrusions 224. Further, body 222 presents second protrusions 228 extending at distal end. Second protrusions 228 extend from body 222, and present second cut-sections 230 formed by chipping off a portion of material from second protrusions 228. As can be seen, second protrusions 228 are curved inwards facing first protrusions 224.

In order to connect to magnetic fractional weight plates 202 to adjustable weight-lifting device 204, a user (not shown) removes magnetic fractional weight plates 202 from rack 208 and connects magnetic fractional weight plates 202 to interfacing grooves 212, as shown in FIG. 8. Specifically, the user connects magnetic fractional weight plates 202 such that first protrusions 224 sit in interfacing grooves 212, and second protrusions 228 sit above first weight plate 205. The user adds a pair of magnetic fractional weight plates 202 i.e., each magnetic fractional weight plate 202 to opposite weight plates 205. As each magnetic fractional weight plate 202 weighs 1.25 pounds, two magnetic fractional weight plates 202 add a total of 2.5 pounds to adjustable weight-lifting device 204. After connecting, the user adjusts handle 207 to connect to required weight plates 205 depending on the need and lifts adjustable weight-lifting device 204 connecting magnetic fractional weight plates 202.

Although the present description is explained considering the magnetic fractional weight plates magnetically attach to the adjustable dumbbells, a person skilled in the art understands that it is possible to magnetically attach to the weight plates of the barbell without coming in contact with a bar of the barbell, in order to increase fractional weight of the barbell. Such implementations or modifications thereof fall within the scope of the present invention.

Furthermore, the disclosed magnetic fractional weight plate may include a body having only a pie-like structure, an arc-like configuration, or three quadrant circular configuration. The entire body may magnetically attach to the weight plate. Optionally, a portion of the body may include magnetic members for attachment to the weight plate. In another aspect, the body may include one or more magnetic members flush with its surface. The magnetic members may be positioned variably across the body and serve to magnetically connect the body to the weight plate. In some implementations, the protrusions extending from the body may function as magnetic members for connection to the weight plate. Additionally, the magnetic fractional weight plate may feature grooves along the body and receive protrusions extending from the weight plate. Those skilled in the art will understand that the combinations of the features described above for the magnetic fractional weight plate fall within the scope of the present invention.

It should be understood that the presently disclosed magnetic fractional weight plates connect directly to the weight plates themselves and do not interfere with the operation of the handle and adjusting of the weights/weight plates. When compared to U.S. Pat. No. 11,324,988, entitled "Weight modification clamp and method" ("the '988 Patent"), the presently disclosed magnetic fractional weight plates do not come in contact with the user once they are placed over the weight plates of the adjustable weight-lifting device, such as adjustable dumbbells. Further, the presently disclosed magnetic fractional weights are configured to be placed closer to the handle unlike in some of the prior art disclosures where the fine weight-adjustment devices are placed at the distal ends of the weight plates. Due to the placement of the magnetic fractional weight plates at interfacing weight plates, the user does not have to remove and re-add the magnetic fractional weight plates each time the user adds or removes the weight plates. Further, the magnetic fractional weight plates connect to the weight plates magnetically and avoids falling over when the user is working out.

A person skilled in the art appreciates that the magnetic fractional weight plates can come in a variety of shapes and sizes depending on the need and comfort of the user. Further, many changes in the design and placement of components may take place without deviating from the scope of the presently disclosed magnetic fractional weight plates.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A magnetic fractional weight plate, comprising:

a body; and a plurality of protrusions rigidly extending from said body, wherein said plurality of protrusions are configured to laterally insert into grooves provided in a weight plate of an adjustable weightlifting device, wherein said body or said plurality of protrusions are configured to magnetically attach to said weight plate, wherein said body has a quarter-circle configuration or three-quadrant circular configuration and two of said plurality of protrusions are positioned adjacent distal ends of said body.

2. The magnetic fractional weight plate of claim 1, wherein said adjustable weight-lifting device comprises one of a dumbbell and a barbell.

3. The magnetic fractional weight plate of claim 1, wherein said plurality of protrusions come in rectangular configuration.

4. The magnetic fractional weight plate of claim 1, wherein said magnetic fractional weight plate has a weight of 1.25 or 2.5 pounds.

5. A magnetic fractional weight plate, comprising:

a pair of magnetic fractional weight plates, each magnetic fractional weight plate comprising:

a body; and a plurality of protrusions rigidly extending from said body, wherein said pair of magnetic fractional weight plates magnetically attach to interfacing weight plates of an adjustable weight-lifting device for adding fractional weights to said adjustable weight-lifting device, wherein said plurality of protrusions are configured to laterally insert into grooves provided in a weight plate of said weight plates, wherein said body has an arc-shaped configuration and two of said plurality of protrusions are positioned adjacent distal ends of said body, and wherein said adjustable weight-lifting device is an adjustable dumbbell.

6. The magnetic fractional weight plate of claim 5, wherein said body comes in a quarter-circle configuration.

7. The magnetic fractional weight plate of claim 5, wherein said plurality of protrusions come in rectangular configuration.

8. The magnetic fractional weight plate of claim 5, wherein said magnetic fractional weight plate has a weight of 1.25 or 2.5 pounds.

9. The magnetic fractional weight plate of claim 5, wherein additional ones of said plurality of protrusions comprises a first section and first protrusions, wherein said first section is positioned at the center of said body, wherein said first protrusions position at sides of said first section.

* * * * *